US008422694B2

(12) United States Patent
Morito et al.

(10) Patent No.: US 8,422,694 B2
(45) Date of Patent: Apr. 16, 2013

(54) SOURCE SOUND SEPARATOR WITH SPECTRUM ANALYSIS THROUGH LINEAR COMBINATION AND METHOD THEREFOR

(75) Inventors: Makoto Morito, Kanagawa (JP); Takashi Yazu, Kanagawa (JP); Kei Yamada, Saitama (JP); Tetsunori Kobayashi, Tokyo (JP); Kenzo Akagiri, Kanagawa (JP); Tetsuji Ogawa, Kanagawa (JP)

(73) Assignees: Oki Electric Industry Co., Ltd., Tokyo (JP); Waseda University, Tokyo (JP)

( * ) Notice: Subject to any disclaimer, the term of this patent is extended or adjusted under 35 U.S.C. 154(b) by 209 days.

(21) Appl. No.: 12/926,820

(22) Filed: Dec. 10, 2010

(65) Prior Publication Data

US 2011/0142252 A1 Jun. 16, 2011

(30) Foreign Application Priority Data

Dec. 11, 2009 (JP) ..... 2009-282024

(51) Int. Cl.
*H04R 3/00* (2006.01)
*H04R 29/00* (2006.01)

(52) U.S. Cl.
USPC ..... 381/92; 381/56; 381/111

(58) Field of Classification Search ..... 381/92, 381/122, 111, 56, 26, 94.1
See application file for complete search history.

(56) References Cited

U.S. PATENT DOCUMENTS

2009/0323977 A1 12/2009 Kobayashi et al.

FOREIGN PATENT DOCUMENTS

JP 10-313497 11/1998

*Primary Examiner* — Xu Mei
*Assistant Examiner* — Douglas Suthers
(74) *Attorney, Agent, or Firm* — Rabin & Berdo, P.C.

(57) ABSTRACT

In a source sound separator, first and second target sound predominant spectra are generated respectively by first and second processing operations for linear combination for emphasizing the target sound, using received sound signals of two microphones arrayed at a distance from each other. A target sound suppressed spectrum is generated by processing for linear combination for suppression of the target sound, using the two received sound signals. Further, a phase signal containing a larger amount of signal components of the target sound and exhibiting directivity in the direction of the target sound is generated by processing of linear combination, using the two received sound signals. The target sound and the interfering sound are separated from each other using the first and second target sound predominant spectra, the target sound suppressed spectrum, and the phase signal.

3 Claims, 4 Drawing Sheets

SOURCE SOUND SEPARATOR WITH SPECTRUM ANALYSIS THROUGH LINEAR COMBINATION AND METHOD THEREFOR

BACKGROUND OF THE INVENTION

1. Field of the Invention

The present invention relates to a source sound separator and a method therefor, and more particularly to a source sound separator and a method for separating a target voice with an interfering sound isolated which comes from a direction other than the direction of the target voice.

2. Description of the Background Art

Such a source sound separator is applicable to, e.g. a mobile device, such as a mobile phone, or a vehicle-laden device, such as a car navigation system. In exploiting voice recognition or telephone message recording, there may be raised such a problem that the voice captured by a microphone may severely be deteriorated in precision of voice recognition by ambient noise, or that the recorded voice may become hardly perceptible due to such noise. Under such circumstances, attempts have been made to use a microphone array to control the directivity characteristics to thereby selectively get just the voice of interest. However, simply controlling the directivity characteristics is not sufficient if it is intended to take out the voice of interest in a state separated from the background noise.

The solution of controlling the directivity characteristics by a microphone array is known per se. For example, solutions for directivity characteristic control by a delayed sum array (DSA) or beam forming (BF), or for directivity characteristic control by a directionally constrained minimization of power (DCMP) adaptive array have been known to date.

As solutions for separating a voice remotely uttered, there has been known a solution, termed SAFIA, in which signals output from fixed plural microphones are subject to the narrow-band spectral analysis and a microphone having yielded the maximum amplitude in each of the frequency bands is allotted to capturing sound in that frequency band, as disclosed by Japanese Patent Laid-Open Publication No. 313497/1998. In this solution of voice separation based on bandwidth selection (BS), in order to obtain a target voice, such a microphone is selected which resides closest to a sound source uttering the target voice, and the sound in the frequency band allocated to that microphone is used to synthesize voice.

In the SAFIA, described above, two signals, when overlapping, may be separated from each other. If there are three or more sound sources, these signals could theoretically be separated one from another whereas the performance of separation would severely be deteriorated. Thus, if there are plural noise sources, it becomes extremely difficult to separate the target sound to high precision from the received sound signal corrupted with multiple noise signals.

A further solution improved over the band selection has been proposed in U.S. Patent Application Publication No. US 2009/0323977 A1 to Kobayashi et al. In the method taught by Kobayashi et al., as will be described in detail later on, the frequency characteristics, with which the sound signals, e.g. voice or acoustic signals, from respective sound sources are properly emphasized, are calculated. However, the signal captured by a microphone may contain an interfering sound in addition to a target sound. Hence, it cannot but be said that those solutions are improper to use in the vicinity of the last stage of elimination of the interfering sound. Under such a situation, the sound quality is deteriorated after ultimate source sound separation.

SUMMARY OF THE INVENTION

It is an object of the present invention to provide a source sound separator and a method therefor with which, even when there are plural interfering sounds, the source sound may readily be separated with the optimum sound quality of the separated target sound.

In accordance with the present invention, a source sound separator for separating a target sound and an interfering sound from each other, the interfering sound incoming from an optional direction different from the incoming direction of the target sound, comprises: a first spectrum generator for using received sound signals of two of a plurality of microphones arranged spaced apart from one another to perform first processing for linear combination for emphasizing a target sound in a time or frequency domain to thereby generate at least one first target sound predominant spectrum; a second spectrum generator for using the received sound signals of the two microphones used for generating the first target sound predominant spectrum to perform second processing of linear combination for emphasizing the target sound in the time or frequency domain to thereby generate at least one second target sound predominant spectrum; a third spectrum generator for using the received sound signals of the two microphones used for generating the first target sound predominant spectrum to perform third processing for linear combination for suppressing the target sound in the time or frequency domain to thereby generate at least one target sound suppressed spectrum which is to form a set with the first and second target sound predominant spectra; a phase generator for using received sound signals of ones of the plurality of microphones to perform processing of linear combination in the frequency domain to thereby generate a phase signal; and a target sound separator for using the first target sound predominant spectrum, the second target sound predominant spectrum, the target sound suppressed spectrum and the phase signal to separate the target sound and the interfering sound from each other.

Further in accordance with the present invention, a method for separating a target sound and an interfering sound from each other, the interfering sound incoming from a direction different from a direction of the target sound incoming, comprises: preparing a first spectrum generator, a second spectrum generator, a third spectrum generator, a phase generator and a target sound separator; generating by the first spectrum generator at least one first target sound predominant spectrum by using received sound signals of two of a plurality of microphones arranged spaced apart from one another to perform first processing for linear combination for emphasizing a target sound in a time or frequency domain; generating by the second spectrum generator at least one second, target sound predominant spectrum by using received sound signals of the two microphones used for generating the first target sound predominant spectrum to perform second processing for linear combination for emphasizing the target sound in the time or frequency domain; performing by the third spectrum generator processing for linear combination for suppressing the target sound in the time or frequency domain by using the received sound signals of the two microphones used for generating the first target sound predominant spectrum to thereby generate at least one target sound suppressed spectrum which is to form a set with the first and second target sound predominant spectra; performing by the phase generator processing of linear combination in the frequency domain by using received sound signals of ones of the plurality of microphones to thereby generate a phase signal; and separating by the target sound separator the target sound and the interfering sound from each other by using the first target sound predominant spectrum, the second target sound predominant spectrum, the target sound suppressed spectrum and the phase signal.

In accordance with the present invention, a computer program is provided which controls a computer, when installed in and executed on the computer, to separate a target sound and an interfering sound from each other by causing the computer to operate as the source sound separator stated above.

According to the present invention, a source sound may thus readily be separated even when there are plural interfering sounds. In addition, the target sound as separated may be of optimum sound quality.

BRIEF DESCRIPTION OF THE DRAWINGS

The objects and features of the present invention will become more apparent from consideration of the following detailed description taken in conjunction with the accompanying drawings in which.

DESCRIPTION OF THE PREFERRED EMBODIMENTS

Figure 3:
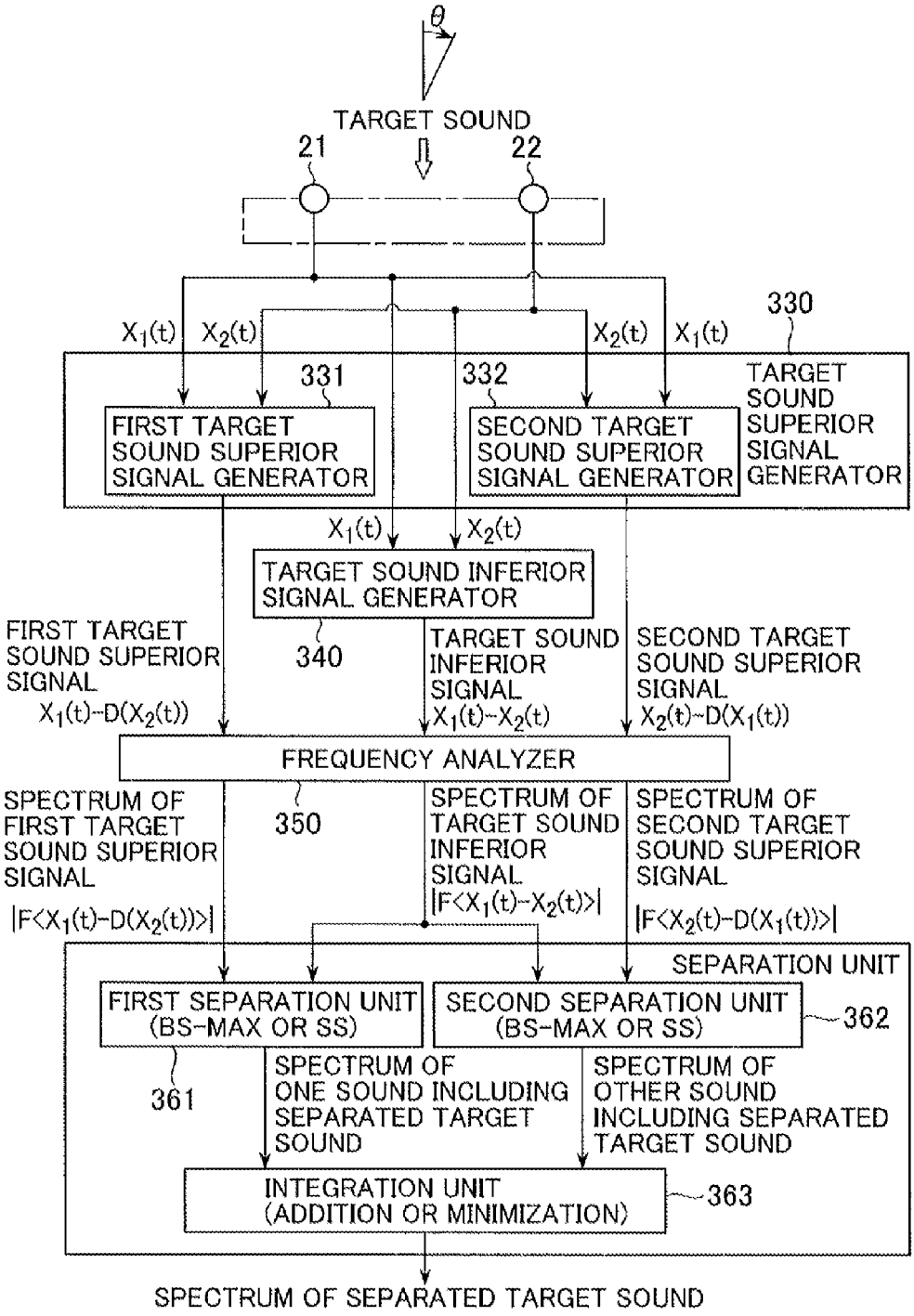
FIG. 3 PRIOR ART
FIG. 3 is a schematic block diagram showing the constitution of a conventional source sound separator.

For better understanding the present invention, the method of source sound separation, disclosed in Kobayashi et al, will now be described in detail with reference to FIG. 3, prior to describing preferred embodiments of the present invention.

In the method of Kobayashi et al., two microphones 21 and 22 are arrayed side-by-side for extending in a direction substantially perpendicular to the direction of an incoming target sound.

In a target sound superior signal generator 330, a first target sound superior signal generator 331 takes a difference between a received sound signal X1(*t*) of the microphone 21 and a signal D(X2(*t*)) in the time or frequency domain, the latter signal D(X2(*t*)) being obtained by delaying the received sound signal of the microphone 22. This difference taken yields a first target sound superior signal X1(*t*)-D(X2(*t*)). A second target sound superior signal generator 332 takes a difference between a received sound signal X2(*t*) of the microphone 22 and a signal D(X1(*t*)) in the time or frequency domain, the latter signal D(X1(*t*)) being obtained by delaying the received sound signal of the microphone 21. This difference taken yields a second target sound superior signal X2(*t*)-D(X1(*t*)). A target sound inferior signal generator 340 takes a difference between the received sound signals X1(*t*) and X2(*t*) of the two microphones 21 and 22 in the time or frequency domain to generate a target sound inferior signal X1(*t*)-X2(*t*). These three signals, x1(*t*) D(X2(*t*)), X2(*t*)-D(X1(*t*)) and X1(*t*)-X2(*t*), are frequency-analyzed by a frequency analyzer section 350.

In a first separation unit 361, band selection or spectral subtraction is carried out using the spectra of the first target sound superior signal and the target sound inferior signal. This separates the sound incoming from the space where the first microphone 21 is located, viz. the space on the left side of FIG. 4B as later described. Also, in a second separation unit 362, band selection or spectral subtraction is carried out using the spectra of the second target sound superior signal and the target sound inferior signal. This separates the sound incoming from the space where the microphone 22 is located, viz. the space on the right side of FIG. 4B. In an integration unit 363, the target sound is separated by processing of spectrum integration using the spectra output from the first separation unit 361 and the second separation unit 362.

In the first and second target sound superior signal generators 331 and 332, and the target sound inferior signal generator 340, a filter, termed a spatial filter, is used.

The spatial filter will now be described with reference to FIGS. 4A and 4B. Assume that, in FIG. 4B, the sound from a sound source is entered at an angle θ onto the two microphones 21 and 22 arranged at a distance d from each other. In this case, the distance between the one microphone 21 and the sound source differs by d×sin θ=T from the distance between the other microphone 22 and the sound source. As a result, a time difference t represented by the following expression (1) is caused between the time points at which the sounds from the sound source arrive at the two microphones:

$$t=(d\times\sin\theta)/(\text{sound propagation speed}) \tag{1}$$

Also, assume that the output of the microphone 21 is delayed by the time difference t from that of the microphone 22, and the resulting delayed output of the microphone 21 is subtracted from the output of the microphone 22. In this case, the two outputs cancel each other, with the result that the sound in the direction of the suppression angle θ is suppressed.

Figure 4B:
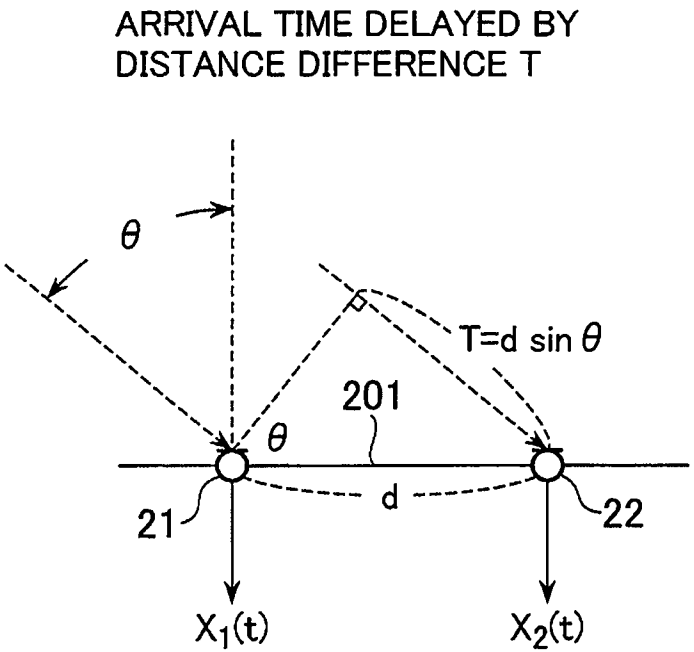
FIGS. 4A and 4B schematically show an acoustic field useful for understanding a spatial filter.
Figure 4A:
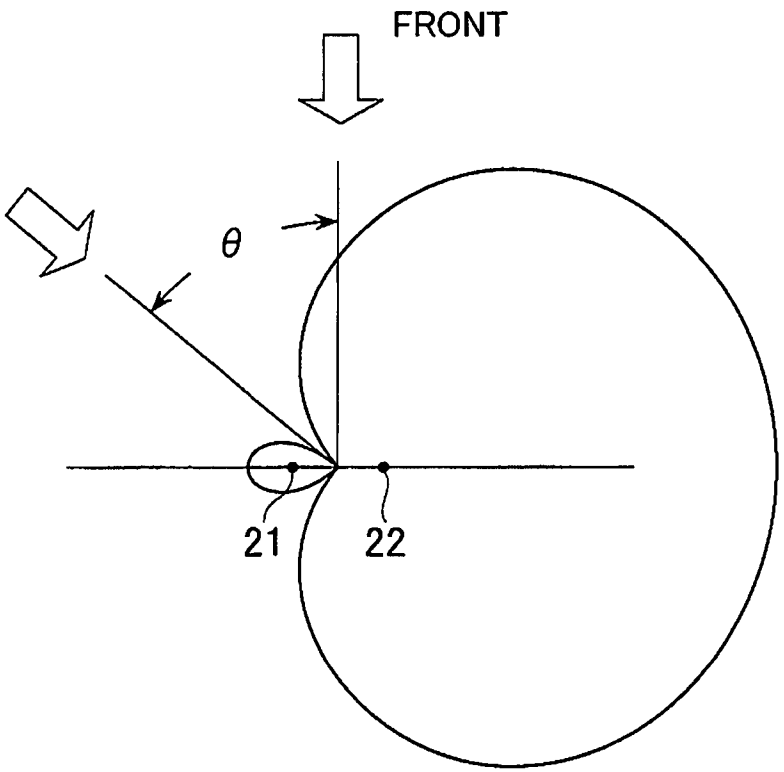

FIG. 4A shows the post-suppression gain of the spatial filter, set to the suppression angle of θ, in terms of variable directions of the sound source. The first and second target sound superior signal generators 331 and 332 use spatial filters, set to the suppression angles of, e.g. −90° and 90°, respectively, to extract the target sound component as well as to suppress the interfering sound component. Further, the target sound inferior signal generator 340 uses a spatial filter, with the suppression angle θ set to 0°, in order to suppress the target sound as well as to extract the interfering sound.

The processing of band selection, performed in the first or second separation unit 361 or 362, includes selection from two spectra with normalization as defined by the expression (2), and calculation of the separation spectrum as defined by the expression (3):

$$S(m)=\begin{cases}0 & \text{if } M(m)<\|N(m)\| \\ \dfrac{\sqrt{M(m)-N(m)}}{\|D1(m)\|} & \text{if } M(m)\geq\|N(m)\|\end{cases} \tag{2}$$

$$H(m)=S(m)D1(m) \tag{3}$$

In the expressions (2) and (3), S(m) denotes an m-th spectral component following the processing of band selection, and M(m) denotes an m-th spectral component of the first or second target sound superior signal. In addition, N(m) denotes an m-th spectral component of the target sound inferior signal, and D(m) denotes an m-th spectral component of the received sound signal of the microphone 21 or 22 associated with the first or second separation unit 361 or 362. H(m) denotes an m-th spectral component of the separation signal.

In the method taught by Kobayashi et al., the frequency characteristics, with which the sound signals, e.g. voice or acoustic signals, from respective sound sources are properly emphasized, are calculated. The amplitude values are compared in magnitude between the corresponding frequency bands in the frequency characteristics, and then properly checked to eliminate the interfering sound. It is seen from the above expressions (2) and (3) that a separation spectrum H(m) is determined using $(M(m)-N(m))^{1/2}$ and the phase of the signal D(m) entered from the one microphone 21 or 22. The signal D(m) entered from the microphone 21 contains an interfering sound in addition to the target sound. Hence, it cannot but be said that those solutions are improper to use in the vicinity of the last stage of elimination of the interfering sound. Under such a situation, the sound quality is deteriorated after ultimate source sound separation.

Now, preferred embodiments of a source sound separator according to the present invention will be described with reference to the drawings. A source sound separator 10, FIG. 1, of the illustrative embodiment may be applied to, but not limitative to, for example, a pre-processor for a voice recognition device as a noise canceller, or a preceding stage of, e.g. a handsfree phone for processing a captured sound, including a mobile phone available as a handsfree phone.

Figure 1:
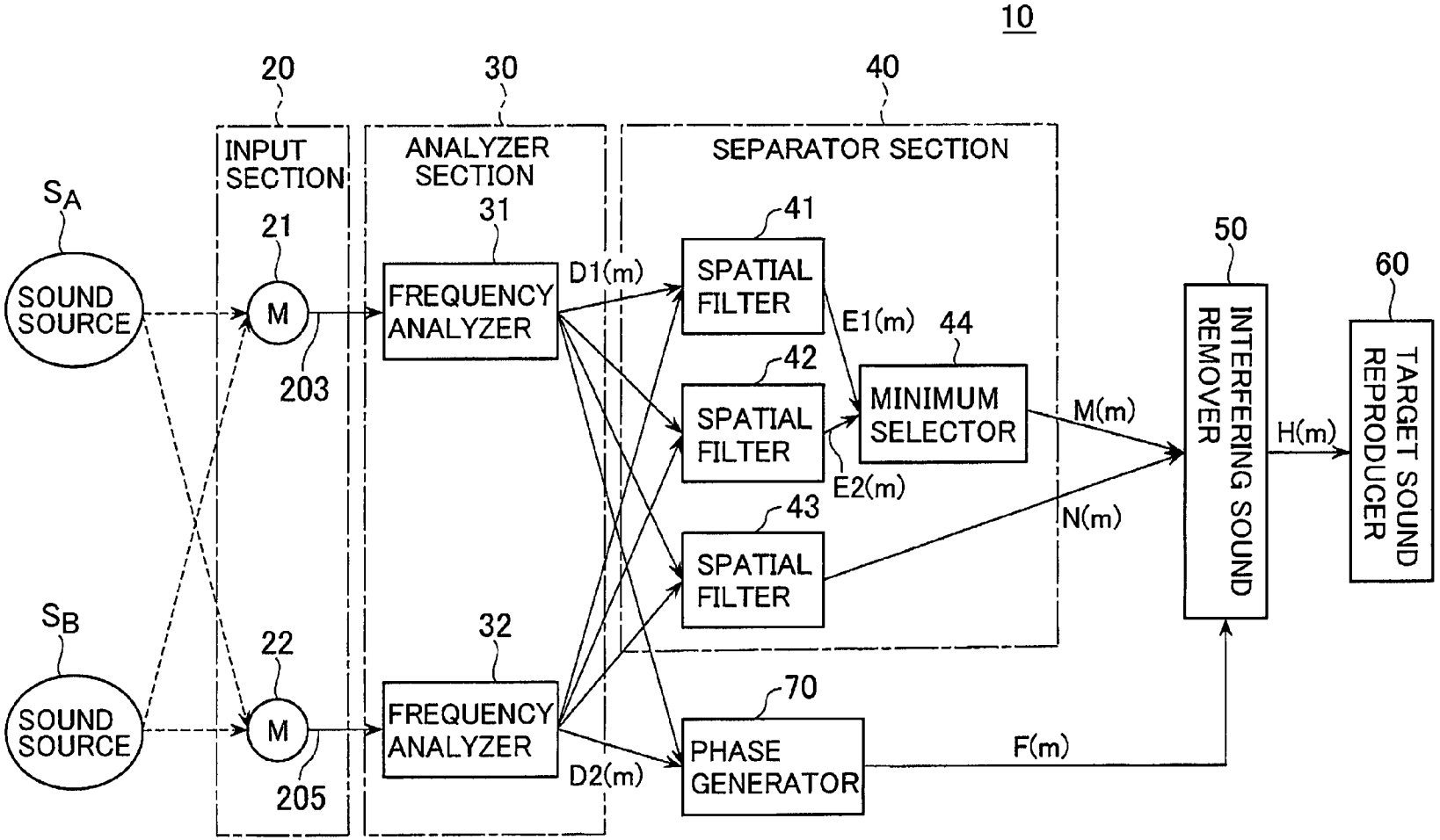
FIG. 1 is a schematic block diagram showing the overall constitution of a source sound separator according to a preferred embodiment of the present invention.

FIG. 1 schematically depicts the overall constitution of the source sound separator 10 according to the illustrative embodiment. The source sound separator 10 may be implemented by a dedicated device composed of discrete devices and/or a single or plural integrated circuits. Alternatively, the illustrative embodiment may partially or entirely be implemented by an information processor or a processor system, such as a personal computer or a digital signal processor, having program sequences and read-only data therefor recorded in a storage medium and installed in the processor system to function, when executed, as a source sound separator. Plural information processors may be arranged to perform distributed processing. Such implementations may not be limitative, and thus anyway the source sound separator 10 may be represented in the form of functional blocks as shown in FIG. 1 from the viewpoint of its function. That may also be the case with an alternative embodiment which will be described below. In this connection, the word "circuit" or "unit" may be understood not only as hardware, such as an electronics circuit, but also as a function that may be implemented by software installed and executed on a computer. Microphones and analog-to-digital converters may of course be implemented by hardware.

With reference to FIG. 1, the source sound separator 10 generally comprises an input section 20, an analyzer section 30, a separator section 40, an interfering sound remover 50, a target sound reproducer 60 and a phase generator 70, which are interconnected as shown.

The input section 20 includes a couple of microphones 21 and 22, in the embodiment, arranged at a distance from each other, and corresponding a couple of analog-to-digital converters, not shown. The microphones 21 and 22 may be omnidirectional, or adapted to exhibit moderate directivity in a direction substantially perpendicular to a straight line 201, FIG. 4B, interconnecting the microphones 21 and 22. Each of the microphones 21 and 22 is arranged to capture a target sound coming from a target sound source the source sound separator 10 intends to catch, and may additionally catch interfering sounds incoming from other sound sources as well as the noise of unknown sound sources. These extraneous sounds may collectively be termed an interfering sound in the context. The analog-to-digital converters, not shown, are provided to convert the voices or acoustic sounds in the ambient space, captured by the respective microphones 21 and 22 as received sound signals 203 and 205, into corresponding digital signals. Thus, signals are designated with reference numerals of connections on which they are conveyed.

It should be noted that means for capturing or receiving a sound of which the signal is to be processed may not be limited to such microphones. For example, the sound signals produced by the two microphones may be recorded on a sound recording medium, and then read out therefrom to be supplied as input signals to the sound source separator 10. Alternatively, two microphones provided on a communication device to which the source sound separator 10 is connected in communication may capture sounds to transmit signals to the separator 10 as input signals. These input signals may be in the form of analog signals or digital signals already converted from the analog signals. Irrespectively of whether the input is obtained by recording and reproduction or over a communication channel, the sound signal comes from a sound originally captured by microphones. Hence, a term 'microphone' may sometimes be understood generally as sound capturing means so as to cover these cases.

Let digital signals captured and analog-to-digital converted by the microphone 21 and 22 be x1($n$) and x2($n$), respectively, where n denotes n-th data sampled at a discrete sampling time point n. The digital signals x1($n$) and x2($n$) come from analog-to-digital converting the received analog sound signal followed by sampling at a sampling period T which may usually be in the order of 31.25 to 125 μs. The subsequent processing is carried out on consecutive N digital signals x1($n$) and x2($n$) falling in a single temporal section as a unit of analysis, i.e. frame. Here, N is a natural number, and set to 1024 (N=1024), for example, with the illustrative embodiment. For example, when a sequence of source sound separation has been processed on one unit of analysis, 3N/4 samples of data corresponding to the rear portion of the N signals x1($n$) and x2($n$) are shifted to the top portion thereof, and newly entered N/4 consecutive samples of data are concatenated to the end of the top portion, i.e. set into the rear portion, to thereby form new N consecutive signals x1($n$) and x2($n$), which will then be processed as a new unit of analysis. The processing will be repeated from one unit of analysis to the next.

The analyzer section 30 includes frequency analyzers 31 and 32 associated with the microphones 21 and 22, respectively. The frequency analyzers 31 and 32 serve as performing frequency analysis on the digital signals x1($n$) and x2($n$)m respectively. Stated differently, the frequency analyzers 31 and 32 respectively convert the digital signals x1($n$) and x2($n$), which are signals in the time domain, into signals in the frequency domain. Here, FFT (Fast Fourier Transform) may be applied for the frequency analysis. In the FFT processing, to N successive samples of data of the digital signals x1($n$) and x2($n$), a window function w(n) is applied. Although a variety of the window functions may be applied, the Hanning window defined by the expression (4) may be applied for example:

$$w(n)=0.5-0.5\times\cos(2nn/N) \tag{4}$$

The windowing is carried out in consideration of the processing for concatenation on the units of analysis which is to be performed in the target sound reproducer 60 as later described. It should be noted that, although application of the window function is desirable, it is not mandatory.

The signals output from the frequency analyzers 31 and 32 are labeled D1($m$) and D2($m$), respectively. The signals in the frequency domain D1($m$) and D2($m$), sometimes referred to as spectra, are expressed by respective complex numbers, where a parameter m denotes the sequential order on the frequency axis, viz. is directed to an m-th band.

It should be noted that the frequency analysis may not be limited to the FFT, but any suitable other methods for frequency analysis, for example, DFT (Discrete Fourier Transform), may be applied. Also, depending on the type of device on which to mount the source sound separator 10 of the illustrative embodiment, any suitable frequency analyzers as implemented in a processor dedicated to other uses may adaptively be used to implement the present embodiment of the source sound separator 10. Such adaptive use is possible, for example, in case a device on which to mount the source sound separator 10 is an IP (Internet Protocol) phone. In the case of IP phone, IP packets have a payload configured into which an FFT output is inserted in a coded form. Such FFT output may adaptively be used as an output of the analyzer section 30.

The separator section 40 serves to extract a sound whose source is located on a vertical plane that substantially crosses the straight line 201 interconnecting the two microphones 21 and 22. Such a sound may be referred to as a target sound. With the instant illustrative embodiment, the separator section 40 includes three spatial filters 41 and 42 and 43 and a minimum spectrum selector 44, which are interconnected as illustrated.

In consideration of the property of the spectrum D(m) such that D(m)=D*(N−m), it may be sufficient that the processing in the components of the separator section 40, as described later, is carried out in a range of $0 \leqq m \leqq N/2$. It is noted that D(m) denotes D1(*m*) or D2(*m*), m is such that $1 \leqq m \leqq N/2-1$ and that D*(N−m) denotes a conjugate complex number of D(N−m).

The spatial filters 41 and 42 play the role of emphasizing a target sound with respect to an interfering sound, viz. rendering a target sound predominant over an interfering sound. The spatial filters 41 and 42 possess specified directivity characteristics different from each other. For example, the one spatial filter 41 is adapted to have a directivity of 90° towards right with respect to the plane substantially perpendicular to the straight line 201 interconnecting the two microphones 21 and 22. That is, the spatial filter 41 has the suppression angle θ, FIGS. 4A and 4B, of 90° clockwise. The other spatial filter 42 is adapted to have a directivity of 90° towards left with respect to the plane substantially perpendicular to the straight line 201 interconnecting the two microphones 21 and 22. That is, the spatial filter 42 has the suppression angle θ of 90° counterclockwise. In mathematical terms, the processing by the spatial filter 41 may be represented by the expression (5), while that by the spatial filter 42 may be represented by the expression (6):

$$E1(m) = D1(m) - D2(m) \cdot e^{\frac{-j2\pi mf}{N}\tau} \tag{5}$$

$$E2(m) = D2(m) - D1(m) \cdot e^{\frac{-j2\pi mf}{N}\tau}, \tag{6}$$

where f denotes a sampling frequency, such as 1,600 Hz. The expressions (5) and (6) are in the form of expression of linear combination of input spectra D1(*m*) and D2(*m*) to the spatial filters 41 and 42, respectively.

The suppression angle θ for the spatial filter 41 may not be limited to 90° clockwise, but may deviate from this value more or less. Similarly, the suppression angle θ for the spatial filter 42 may not be limited to 90° counterclockwise, but may deviate from this value more or less.

The remaining spatial filter 43 plays the role of weakening a target sound with respect to an interfering sound. The spatial filter 43 may be equivalent to the spatial filter earlier described with reference to FIG. 4A in which the suppression angle θ is 0°. More specifically, the spatial filter 43 functions as extracting an interfering sound from a sound source located on the line of extension of the straight line 201 interconnecting the two microphones 21 and 22 to weaken the target sound. In mathematical terms, the processing by the spatial filter 43 may be represented by the following expression (7):

$$N(m)=D1(m)-D2(m) \tag{7}$$

The expression (7) is in the form of expression of linear combination of the input spectra D1(*m*) and D2(*m*) to the spatial filter 43.

The minimum selector 44 functions to produce a target sound-emphasized spectrum M(m) which is a combination of spectra E1(*m*) and E2(*m*), which have the target sound emphasized and output from the spatial filters 41 and 42, respectively. The minimum selector 44 performs the processing by which the absolute value of the output spectrum E1(*m*) or E2(*m*) of the spatial filter 41 or 42, respectively, whichever is smaller, i.e. minimum, is rendered a component of the output spectrum M(m) from the minimum selector 44, as indicated by the expression (8):

$$M(m)=\min(\|E1(m)\|,\|E2(m)\|), \tag{8}$$

where ||x|| stands for the absolute value of x.

The phase generator 70 is adapted to use the output spectra D1(*m*) and D2(*m*) from the frequency analyzers 31 and 32. respectively, to generate a spectrum F(m), referred to below as a phase spectrum, which contains a larger amount of, or stronger, target sound component and is for use in separating the target sound. The phase generator 70 adds the output spectra D1(*m*) and D2(*m*) from the frequency analyzers 31 and 32, respectively, to each other as indicated by the expression (9) to thereby produce the phase spectrum F(m):

$$F(m)=D1(m)+D2(m) \tag{9}$$

The phase generator 70, calculating the expression (9), may be formed by a spatial filter exhibiting the directivity predominantly in the direction of a target sound. The phase spectrum F(m) exhibits the directivity in the direction of the target sound, by its characteristics, and hence contains a larger amount of signal component of the target sound. The phase components of the signal component are continuous and free from steep characteristics because selection on a band-by-band basis is not performed.

It should be noted that the phase information for use in separating a target source sound needs to contain a larger amount of target sound. It may thus be contemplated to use the phase component of the signal obtained on band selection. However, the band selection may lead to discontinuity in phase component, such that, if the signal obtained on band selection is used, the as-separated target sound may be deteriorated in sound quality. It is thus appropriate to use a spatial filter that will calculate the expression (9).

The interfering sound remover 50 functions to use the output spectra M(m), N(m) and F(m) of the minimum selector 44, the spatial filter 43 and the phase generator 70, respectively, to obtain an output having the interfering sound removed. Stated differently, the interfering sound remover 50 gets an output which is only the target sound separated and extracted. The interfering sound remover 50 performs the processing of selection from the two spectra M(m) and N(m), accompanied by normalization, as represented by the expression (10) as well as the processing of applying the spectrum S(m) thus obtained and calculating the separation spectrum H(m), indicated by the expression (11):

$$S(m) = \begin{cases} 0 & \text{if } M(m) < \|N(m)\| \\ \dfrac{\sqrt{M(m) - N(m)}}{\|F(m)\|} & \text{if } M(m) \geq \|N(m)\| \end{cases} \quad (10)$$

$$H(m) = S(m)F(m) \quad (11)$$

It is to be noted that the expressions (10) and (11) are executed within a range of $0 \leqq m \leqq N/2$, in consideration of the relationship between the complex number and the conjugate complex number described above. Thus, the interfering sound remover 50 uses the separation spectrum H(m) within the range of $0 \leqq m \leqq N/2$, thus obtained in accordance with the expression (11), on the basis of the relationship $H(m)=H^*(N-m)$ between the complex number and the conjugate complex number where $N/2+1 \leqq m \leqq N-1$ to find the separation spectrum H(m) in a range of $0 \leqq m \leqq N-1$.

The target sound reproducer 60 is adapted to transform the separation spectrum, i.e. spectrum freed of interference sound, H(m), which is a signal in the frequency domain, into a signal in the time domain, and to concatenate the signals obtained on a unit of analysis-by-unit basis to thereby restore a continuous signal. The target sound reproducer 60 may also perform digital-to-analog conversion as necessary. Specifically, the target sound reproducer 60 performs N-point inverse FFT on the separation spectrum H(m) to obtain a source sound separation signal h(m). The target sound reproducer 60 then sums the current source sound separation signal h(n) to the latter 3N/4 samples of data of the source sound separation signal h'(n) of an immediately preceding unit of analysis to thereby get an ultimate separation signal y(n):

$$y(n)=h(n)+h'(n+N/4) \quad (12)$$

Thus, the afore-mentioned processing is performed with N/4 samples of data being shifted so as to overlap the samples of data between neighboring units of analysis in order to smoothen the waveform concatenation. This solution may advantageously be applied. On each unit of analysis, a period of time equal to NT/4 is allowed to perform the above-mentioned sequence of processing from the analyzer section 30 to the target sound reproducer 60.

Depending on the use of the source sound separator 10, the target sound reproducer 60 may be omitted, and replaced by a reproducer function contained in another device. For example, if the source sound separator 10 is used for a voice recognition device, the separation spectrum H(m) may be used as a characteristic value for recognition, with the target sound reproducer 60 omitted. For example, if the source sound separator 10 is applied to an IP phone, as including the reproducer function, the latter may adaptively be used.

In operation, received sound signals 203 and 205, respectively, obtained by the microphones 21 and 22 capturing sounds therearound, are converted into digital signals x1(*n*) and x2(*n*). The digital signals are grouped by units of analysis which are then delivered to the analyzer section 30.

In the analyzer section 30, the digital signals x1(*n*) and x2(*n*) are frequency analyzed by the frequency analyzers 31 and 32, respectively, to yield spectrum signals D1(*m*) and D2(*m*). The spectrum signals are delivered to the spatial filters 41, 42 and 43 and the phase generator 70.

In the spatial filter 41, the calculations on the spectra D1(*m*) and D2(*m*), defined by the expression (5), are carried out to yield the spectrum E1(*m*), in which the interfering sound in the direction of 90° towards right with respect to the plane substantially perpendicular to the straight line 201, FIG. 4B, interconnecting the two microphones 21 and 22 is suppressed to emphasize the target sound. In the spatial filter 42, the calculations on the spectra D1(*m*) and D2(*m*), defined by the expression (6), are carried out to produce the spectrum E2(*m*), in which the interfering sound in the direction of 90° towards left with respect to the plane substantially perpendicular to the straight line 201 interconnecting the two microphones 21 and 22 is suppressed to emphasize the target sound. In the minimum selector 44, the absolute value of the output spectrum E1(*m*) or E2(*m*) from the respective spatial filter 41 or 42, whichever is smaller, i.e. minimum, is selected, from one frequency band to another, as indicated by the expression (8). In this manner, the post-integration spectrum M(m), which has emphasized the target sound, is obtained and in turn delivered to the interfering sound remover 50.

In the third spatial filter 43, the calculations on the spectra D1(*m*) and D2(*m*), defined by the expression (7), are carried out. Thus, the interfering sound from sound sources, located on the line of extension of the straight line 201 interconnecting the couple of microphones 21 and 22, is extracted. A vector N(m), in which the target sound has been weakened in comparison with the interfering sound, is obtained and delivered to the interfering sound remover 50.

In the phase generator 70, the calculations on the spectra D1(*m*) and D2(*m*), as indicated by the expression (9), are carried out to yield the phase spectrum F(m). The phase spectrum F(m), which contains a larger amount of target sound and is used for separating the target sound, is delivered to the interfering sound remover 50.

In the interfering sound remover 50, selection from the two spectra M(m) and N(m), defined by the expression (10) with normalization, is carried out with the phase spectrum F(m) applied. The calculation of the separation spectrum H(m), defined by the expression (11), and the widening of the range of m of the separation spectrum H(m), are carried out. The separation spectrum H(m), resultant from the widening of the range, will be delivered to the target sound reproducer 60.

In the target sound reproducer 60, the separation spectrum H(m) in the frequency domain is transformed into a corresponding signal in the time domain. The processing for signal concatenation as indicated by the expression (12) is then carried out, from one unit of analysis to another, to yield the ultimate separation signal y(n).

Thus, the illustrative embodiment has its basic processing relying upon band selection, and hence the target sound may be separated with ease. Moreover, the phase information for use in target source sound separation is obtained by synthesizing received plural sound signals 203 and 205. Hence, even when a larger amount of interfering sound is contained in the received sound signals, a stable phase component in the target sound may be used for separating the target sound, resulting in the improved sound quality of the as-separated target sound.

Now, with reference to FIG. 2, a source sound separator 100 according to an alternative embodiment of the present invention will be described. While the source sound separator of the illustrative embodiment described above uses two microphones, the present alternative embodiment uses four microphones.

Figure 2:
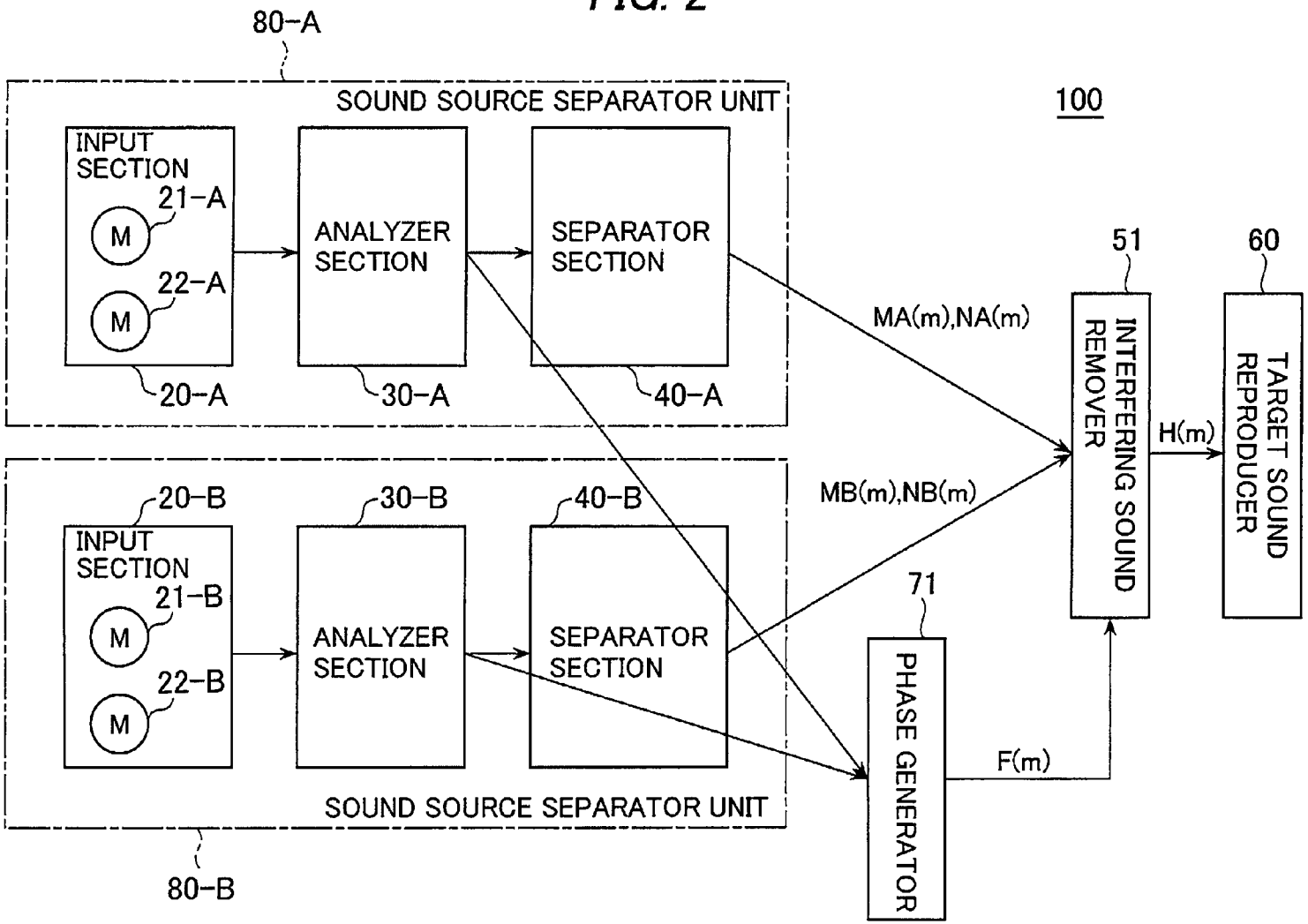
FIG. 2 is a schematic block diagram showing the overall constitution of a source sound separator according to an alternative embodiment of the present invention.

FIG. 2 depicts in a schematic block diagram the overall constitution of the source sound separator 100 according to the alternative embodiment. Like elements or components are designated with the same referenced numerals. The source sound separator 100 generally includes a pair of sound source separator units 80-A and 80-B, an interfering sound remover 51 and the phase generator 71, in addition to the target sound reproducer 60, which are interconnected as depicted. The one sound source separator unit 80-A includes an input section 20-A, an analyzer section 30-A and a separator section 40-A which are interconnected as depicted, while the other sound source separator unit 80-B includes an input section 20-B, an analyzer section 30-B and a separator section 40-B which are interconnected as shown.

The input sections 20-A and 20-B may be equivalent to the input section 20 of the illustrative embodiment shown in and described with reference to FIG. 1. The analyzer sections 30-A and 30-B may be equivalent to the analyzer section 30 of the embodiment shown in FIG. 1, while the separator sections 40-A and 40-B may be equivalent to the separator section 40 of the embodiment of FIG. 1. As such, the constituent components included in each of the sound source separator units 80-A and 80-B are designated with the reference numerals of the components corresponding to those shown in FIG. 1 and followed by corresponding letters A or B.

As shown, the source sound separator 100 includes the four microphones 21-A and 21-B, and 22A and 22-B. The one pair of microphones 21-A and 22-A are connected to the input section 20-A of the one sound source separator unit 80-A. The other pair of microphones 21-B and 22-B are connected to the input section 20-B of the other sound source separator unit 80-B. For example, the two pairs of microphones may preferably be disposed such that a straight line, corresponding to 201, FIG. 4B, interconnecting the microphones 21-A and 22-A substantially cross a straight line (201) interconnecting the microphones 21-B and 22-B.

The phase generator 71 of the alternative embodiment is interconnected to be supplied with two frequency analysis spectra DA1($m$) and DA2(M), output from the one analyzer section 30-A, while being supplied with two frequency analysis spectra DB1($m$) and DB2($m$), output from the other analyzer section 30-B. The phase generator 71 sums the four input spectra DA1($m$), DA2($m$), DB1($m$) and DB2($m$) together to thereby produce a phase spectrum F(m), as indicated by the expression (13):

$$F(m)=DA1(m)+DA2(m)+DB1(m)+DB2(m) \tag{13}$$

With the instant alternative embodiment also, the phase spectrum F(m) is a simple sum of spectra, although of the four microphones, and thus contains a larger amount of signal components of the target sound. Since selection on the band basis has not been made, the phase components are continuous and are not steep in characteristics.

The interfering sound remover 51 of the alternative embodiment is interconnected to be supplied with output spectra MA(m) and NA(m) of a minimum selector 44-A and a spatial filter 43-A of the separator section 40-A, which are not shown in the figure but may correspond to the minimum selector 44 and the spatial filter 43, respectively. The interfering sound remover 51 is also interconnected to be supplied with output spectra MB(m) and NB(m) of a minimum spectrum selector 44-B and a spatial filter 43-B of the separator section 40-B. Similarly, the minimum spectrum selector 44-B and the spatial filter 43-B are not depicted in the figure but may correspond to the minimum selector 44 and the spatial filter 43, respectively. Furthermore, the interfering sound remover 51 is connected to be fed with an output spectrum F(m) of the phase generator 71.

The interfering sound remover 51 is adapted for using these five spectra MA(m), NA(m), MB(m), NB(m) and F(m) to perform band selection accompanied by normalization, as indicated by the expression (14):

$$S(m) = \begin{cases} \dfrac{\sqrt{MB(m)-NB(m)}}{\|F(m)\|} & \text{if } MA(m) \geq MB(m) \text{ and } MB(m) \geq \|NB(m)\| \\ \dfrac{\sqrt{MA(m)-NA(m)}}{\|F(m)\|} & \text{if } MB(m) \geq MA(m) \text{ and } MA(m) \geq \|NA(m)\| \\ 0 & \text{otherwise} \end{cases} \tag{14}$$

In the expression (14), the former part of the first condition shows a case where the target sound predominant spectrum of the sound source separator unit 80-A is higher in power than the target sound predominant spectrum of the sound source separator unit 80-B. The former part of the second condition represents a case where the target sound predominant spectrum of the sound source separator unit 80-B is higher in power than the target sound predominant spectrum of the sound source separator unit 80-A. It is thus revealed that band selection is carried out between the sound source separator units 80-A and 80-B.

As in the previous embodiment shown in FIG. 1, the interfering sound remover 51 applies the spectrum S(m) of the result of the band selection and the output spectrum F(m) from the phase generator 71 to calculate the separation spectrum H(m). The interfering sound remover then widens the range of m of the separation spectrum H(m).

With the alternative embodiment, band selection is performed as the basic processing, and hence the target sound may be separated with ease. Moreover, even in case the received sound signal contains a larger amount of interfering sound, the phase component of the stable target sound may be used for target source sound separation. As a result, the target sound as separated may be improved in sound quality.

The alternative embodiment uses the two microphones 21-A and 22-A of the sound source separator unit 80-A and the two microphones 21-B, 22-B of the sound source separator unit 80-B, totaling at four microphones. Alternatively, three microphones in total may be connected to the sound source separator units 80-A and 80-B with one of the microphones connected in common, thus reducing the microphones in number. Moreover, certain calculations, such as calculations for frequency analysis, may be common to both sound source separator units 80-A and 80-B. Hence, the ultimate calculations are decreased in volume so as to be practically useful. In that case, the phase generator 71 may be adapted to simply sum the spectra of frequency analysis for those three microphones together, or alternatively to sum the spectra with a weight given to the spectrum for frequency analysis for the common microphone, e.g. twice as large as the remaining spectra for frequency analysis.

It is also possible to use a constitution different from that described above in case of using three microphones. For example, three microphones may be placed at the apices of an isosceles triangle. For processing, the first and second microphones may be connected to a sound source separator unit, like, e.g. 80-A, whilst the second and third microphones may be connected to another sound source separator unit. The second and third microphones may then be connected to a still another sound source separator unit.

Five or more microphones may be arranged number and similar processing operations for source sound separation may be performed accordingly. In this case, it is sufficient to adapt the phase generator 71 so as to sum the spectra of frequency analysis for the respective microphones together. It is also sufficient to adapt the interfering sound remover 51 so as to find the smallest, i.e. minimum, value to select an appropriate sound source separator unit, like, i.e. 80-A, as with the alternative embodiment described above, and to get the band selection spectrum S(m) from the target sound predominant spectrum and the target sound adverse or inferior spectrum in the so selected source sound selector unit.

In the illustrative embodiments described above, most of all processing operations are carried out in terms of signals in the frequency domain, i.e. spectra. Some of those processing operations may, however, be carried out in terms of signals in the time domain.

The source sound separator according to the present invention is advantageously applicable to separating the voice of a speaker of interest from a mixture of voices of plural speakers uttering in remote places. The source sound separator may also be applied to separating the voice of a speaker of interest from a mixture of voices of plural speakers uttering in remote places with other sounds. More specifically, the source sound separator of the present invention may advantageously be applied to dialogs with a robot, vocal manipulation on vehicle-laden equipment, such as a car navigation system, or to preparation of conference minutes.

The entire disclosure of Japanese patent application No. 2009-282024 filed on Dec. 11, 2009, including the specification, claims, accompanying drawings and abstract of the disclosure is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What we claim is:

1. A source sound separator for separating a target sound and an interfering sound from each other, the interfering sound incoming from a direction different from a direction of the target sound incoming, said separator comprising:

one or more circuits configured to implement:

a first spectrum generator for using received first and second sound signals of respective first and second ones of a plurality of microphones arranged spaced apart from one another to subtract from a value for the first sound signal a value obtained by delaying the second sound signal by a first predetermined period of time in a time or frequency domain to thereby generate at least one first target sound predominant spectrum;

a second spectrum generator for subtracting from a value for the second sound signal a value obtained by delaying the first sound signal by a second predetermined period of time in the said time or frequency domain to thereby generate at least one second target sound predominant spectrum;

a third spectrum generator for using the received first and second sound signals to perform processing for linear combination for suppressing the target sound in said time or frequency domain to thereby generate at least one target sound suppressed spectrum which is to form a set with the first and second target sound predominant spectra;

a phase generator for using received sound signals of ones of the plurality of microphones to add the received sound signals in the frequency domain to thereby generate a phase signal; and a target sound separator for using the first target sound predominant spectrum, the second target sound predominant spectrum, the target sound suppressed spectrum and the phase signal to separate the target sound and the interfering sound from each other.

2. A method for separating a target sound and an interfering sound from each other, the interfering sound incoming from a direction different from a direction of the target sound incoming, said method comprising:

preparing a first spectrum generator, a second spectrum generator, a third spectrum generator, a phase generator and a target sound separator;

generating by the first spectrum generator at least one first target sound predominant spectrum by using received first and second sound signals of respective first and second ones of a plurality of microphones arranged spaced apart from one another to subtract from a value for the first sound signal a value obtained by delaying the second sound signal by a first predetermined period of time in a time or frequency domain;

generating by the second spectrum generator at least one second target sound predominant spectrum by subtracting from a value for the second sound signal a value obtained by delaying the first sound signal by a second predetermined period of time in said time or frequency domain;

performing by the third spectrum generator processing for linear combination for suppressing the target sound in said time or frequency domain by using the received first and second sound signals to thereby generate at least one target sound suppressed spectrum which is to form a set with the first and second target sound predominant spectra;

using by the phase generator received sound signals of ones of the plurality of microphones to add the received sound signals in the frequency domain to thereby generate a phase signal; and separating by the target sound separator the target sound and the interfering sound from each other by using the first target sound predominant spectrum, the second target sound predominant spectrum, the target sound suppressed spectrum and the phase signal.

3. A non-transitory computer-readable storage medium having a computer program recorded and separating, when installed in and executed on a computer, a target sound and an interfering sound from each other, the interfering sound incoming from a direction different from a direction of the target sound incoming, said program allowing the computer to operate as:

a first spectrum generator for using received first and second sound signals of respective first and second ones of a plurality of microphones arranged spaced apart from one another to subtract from a value for the first sound signal a value obtained by delaying the second sound signal by a first predetermined period of time in a time or frequency domain to thereby generate at least one first target sound predominant spectrum;

a second spectrum generator for subtracting from a value for the second sound signal a value obtained by delaying the first sound signal by a second predetermined period of time in said time or frequency domain to thereby generate at least one second target sound predominant spectrum;

a third spectrum generator for using the received first and second sound signals to perform processing for linear combination for suppressing the target sound in said time or frequency domain to thereby generate at least one target sound suppressed spectrum which is to form a set with the first and second target sound predominant spectra;

a phase generator for using received sound signals of ones of the plurality of microphones to add the received sound signals in the frequency domain to thereby generate a phase signal; and a target sound separator for using the first target sound predominant spectrum, the second target sound predominant spectrum, the target sound suppressed spectrum and the phase signal to separate the target sound and the interfering sound from each other.

* * * * *